US009700191B2

(12) United States Patent
Legatt et al.

(10) Patent No.: US 9,700,191 B2
(45) Date of Patent: Jul. 11, 2017

(54) WHEEL LIFT ASSEMBLY FOR FLOOR TREATING APPARATUS

(71) Applicants: Donald Joseph Legatt, St. Michael, MN (US); William Randall Stuchlik, Rogers, AR (US); Robert D. Abrams, Highlands Ranch, CO (US)

(72) Inventors: Donald Joseph Legatt, St. Michael, MN (US); William Randall Stuchlik, Rogers, AR (US); Robert D. Abrams, Highlands Ranch, CO (US)

(73) Assignee: NILFISK, INC., Plymouth, MN (US)

( * ) Notice: Subject to any disclaimer, the term of this patent is extended or adjusted under 35 U.S.C. 154(b) by 90 days.

(21) Appl. No.: 14/685,382

(22) Filed: Apr. 13, 2015

(65) Prior Publication Data

US 2016/0296093 A1 Oct. 13, 2016

(51) Int. Cl.
*A47L 11/40* (2006.01)
*A47L 11/283* (2006.01)

(52) U.S. Cl.
CPC ..... *A47L 11/4069* (2013.01); *A47L 11/283* (2013.01); *A47L 11/4072* (2013.01)

(58) Field of Classification Search
CPC ..... A47L 11/4055; A47L 11/4058; A47L 11/4069; A47L 11/4075; A47L 11/4072
See application file for complete search history.

(56) References Cited

U.S. PATENT DOCUMENTS 2,250,177 A 7/1941 Boccasile
2,675,246 A 4/1954 Arones
2,801,437 A 8/1957 Okun
2,949,619 A 8/1960 Holt
3,027,581 A 4/1962 Holt
3,686,707 A 8/1972 Hughes et al.
4,845,798 A 7/1989 Genovese
5,355,542 A 10/1994 Oreck et al.
5,381,578 A * 1/1995 Armbruster ..... A47L 11/284 15/145
6,425,813 B1 * 7/2002 Ernst ..... B24B 7/186 451/350
6,494,772 B1 12/2002 Barnes et al.
8,356,375 B2 1/2013 Geurkink
8,393,937 B2 3/2013 Goldberg
8,839,479 B2 9/2014 Hruby
(Continued)

OTHER PUBLICATIONS

"Bulldog General-Duty Floor Machine", [online]. © 2003 Mercury Floor Machines, Inc. Retrieved from the Internet: <URL: http://www.mercuryfloormachines.com/PDF/bulldog_manual.pdf>, (2003), 7 pgs.

(Continued)

*Primary Examiner* — Shay Karls

(74) *Attorney, Agent, or Firm* — Schwegman Lundberg & Woessner, P.A.

(57) ABSTRACT

A floor treating apparatus comprises a chassis, a cleaning head assembly and a wheel lift assembly. The chassis has a wheel assembly and a handle assembly. The cleaning head assembly comprises a motor mounting plate that is suspended from the chassis at pivot points. The wheel lift assembly comprises a cam mounted between the chassis and the motor mounting plate, and a lever for rotating the cam to tilt the motor mounting plate on the pivot points.

27 Claims, 13 Drawing Sheets

(56) References Cited

U.S. PATENT DOCUMENTS

| | | | |
|---|---|---|---|
| 2006/0150362 | A1 | 7/2006 | Mitchell |
| 2007/0232207 | A1 | 10/2007 | Palushi |

OTHER PUBLICATIONS

"Extra Heavy Duty Floor Machine—KCD Series", [online]. © 2011 Genfloor LLC. [retrieved on Jul. 10, 2015]]. Retrieved from the Internet: <URL: http://www.genfloor.com/ en/floor-equipment/kcd-series>, (2011), 4 pgs.

"TigerHawk Oscillating Floor Machine", [online]. © 1996-2007 Janilink.com [retrieved on Jul. 15, 2015]. Retrieved from the Internet: <URL: https://www.janilink.com/product_info.php-?products_id=16133>, (2015), 5 pgs.

"Whirlamatic Model 1120E, 1120E-5 Parts List", © 1985 Advance Machine Company, (1985), 6 pgs.

* cited by examiner

WHEEL LIFT ASSEMBLY FOR FLOOR TREATING APPARATUS

TECHNICAL FIELD

The present disclosure pertains generally, but not by way of limitation, to machines used for floor care and maintenance. By way of example only, the present disclosure may relate to wheel assemblies for walk-behind orbital floor scrubbers.

BACKGROUND

A wide variety of floor care and maintenance machines have been developed for various aspects of floor treatment, including, for example, cleaning, scrubbing, finishing, buffing and stripping of floor surfaces. Such machines can be used on hard floor surfaces, such as concrete, tile and wood, as well as for carpet cleaning. Cleaning heads for these floor treating machines typically comprise a treatment surface, such as a pad or brush, that engages with the floor surface and that is connected to a rotary drive means. Cleaning heads having orbital-motion treatment surfaces have the ability to produce multi-directional treatment motions that enhance agitation and are especially effective for polishing or scrubbing. Cleaning heads used in typical orbital-motion floor treating machines impart orbital motion to the treatment surface using a drive train assembly in which force from a rotary drive means, e.g. an electric motor, is transmitted from a drive shaft to the treatment surface through a bearing assembly or flywheel that is eccentrically mounted on the drive shaft. For example, U.S. Patent Application Pub. No. 2006/0150362 to Mitchell describes a floor treating machine that utilizes a cam-driven, rectangular treatment surface.

Cleaning heads for these orbital-motion floor treating machines can be used in walk-behind applications wherein the operator pushes the cleaning head using a cart or truck device. When using these machines, the operator must manually move the entire machine back and forth to create the desired treatment motion, while simultaneously advancing the machine in the desired linear direction. Such manual motion takes much effort and can potentially result in inadequate cleaning because of the inability of the operator to manually move the machine back and forth in a consistent motion. Conventional floor treating machines, orbital or rotary, include wheels that are either always engaged with the floor, such as described in U.S. Pat. No. 8,839,479 to Hruby, or wheels that are connected to various adjustment mechanisms for the wheels, as is described in U.S. Pat. No. 2,675,246 to Arones and U.S. Pat. No. 3,027,581 to Holt.

OVERVIEW

The present inventors have recognized, among other things, that problems to be solved with conventional floor treating machines can include the difficulty for an operator of the floor treating machine to balance the weight of the machine while controlling the path of the treatment motion. In particular, the present inventors have recognized the need to increase the drivability of a walk-behind, orbital floor scrubber. In an example, the subject matter described in this disclosure can provide a solution to this problem by utilizing wheels that are for transporting the floor scrubber as guides for performing scrubbing operations, thereby stabilizing movement of the machine while the scrubber continues to move with orbital motion. In an example, a wheel chassis can be pivoted at a motor mounting plate of a cleaning head assembly to raise and lower the wheels. In an example, the wheels can be lowered to an intermediate position between fully up and fully down, so that the treatment surface can substantially engage the floor surface while the wheels are also in contact with the floor.

This overview is intended to provide an overview of subject matter of the present patent application. It is not intended to provide an exclusive or exhaustive explanation of the present subject matter. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
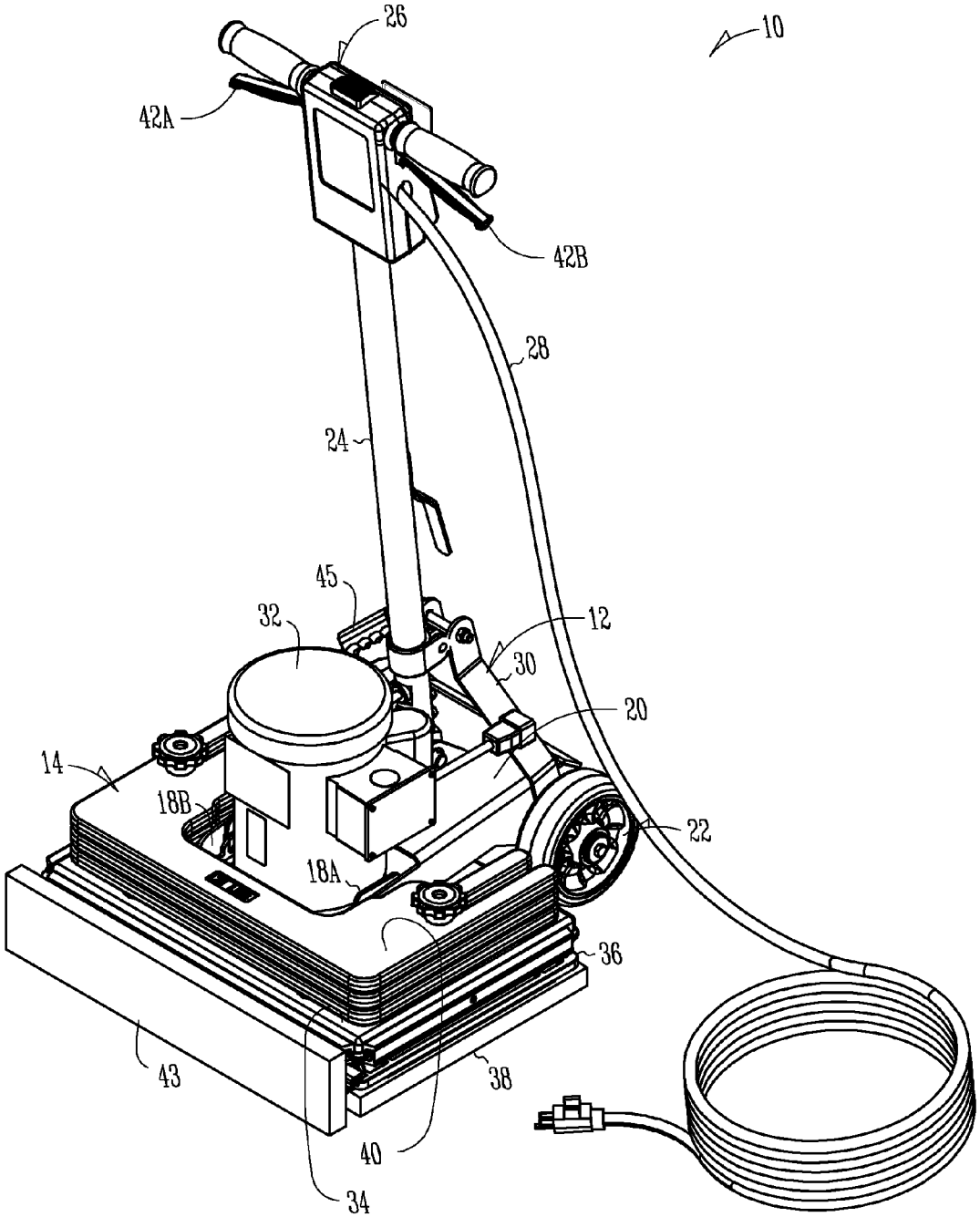
FIG. 1 is a perspective view of a floor scrubber showing a truck unit and a cleaning head assembly.
Figure 2:
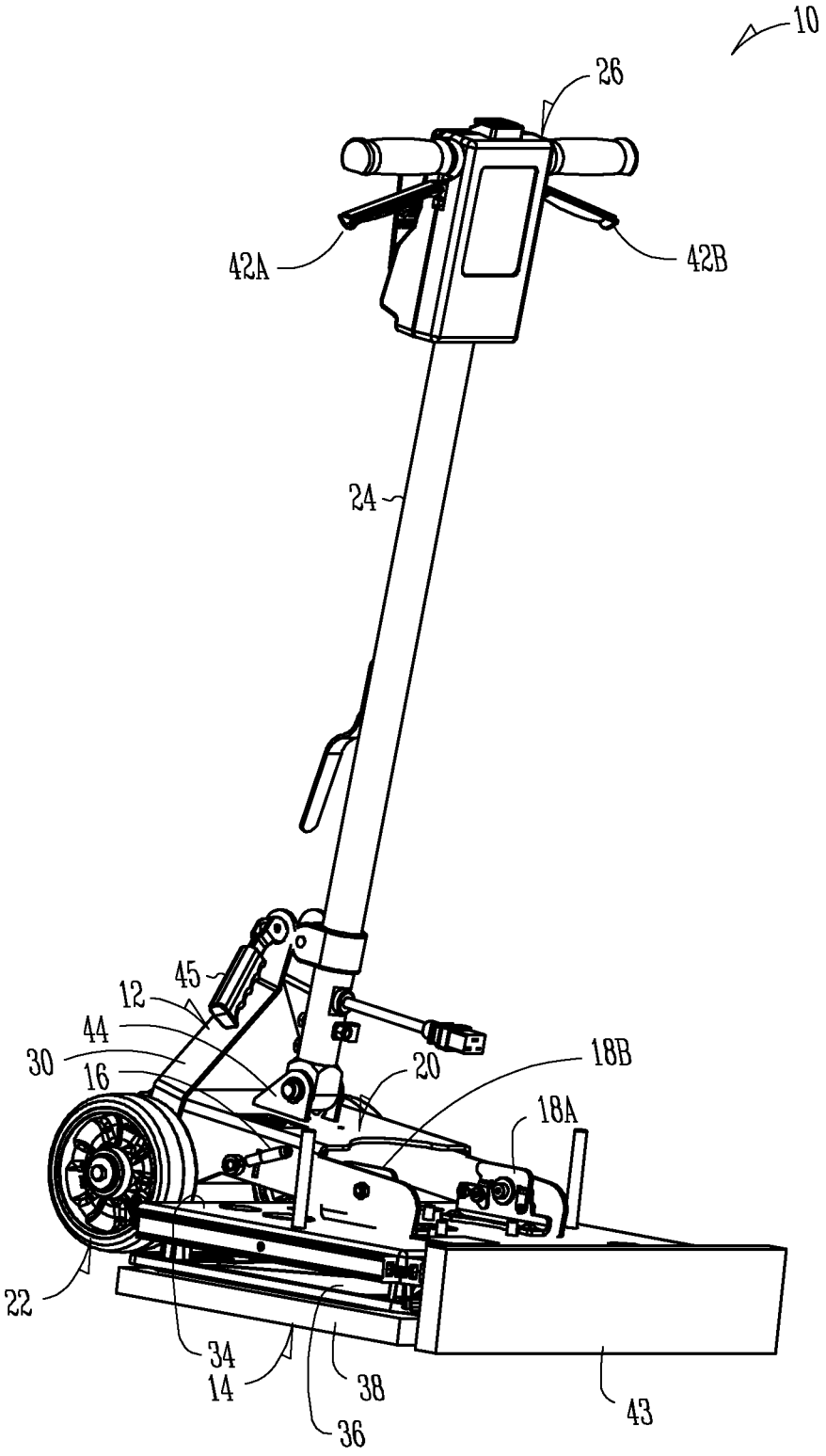
FIG. 2 is a perspective view of the floor scrubber of FIG. 1 with several components removed to show a handle for a wheel lift assembly and a bracket for a pivot assembly.

FIG. 1 is a perspective view of floor scrubber 10 showing truck unit 12 and cleaning head assembly 14. Truck unit 12 includes chassis 20, wheel assembly 22, steering column 24, handle bar 26, power cord 28 and tilt adjuster 30. Cleaning head assembly 14 includes motor 32, motor mounting plate 34, pad drive 36, pad 38 and weights 40. FIG. 2 is a perspective view of floor scrubber 10 of FIG. 1, with motor 32 and weights 40 removed, showing handle 16 for wheel lift assembly 58 of FIG. 4A, and brackets 18A and 18B for connection in pivot assemblies 60A and 60B of FIG. 4A.

Figure 7:
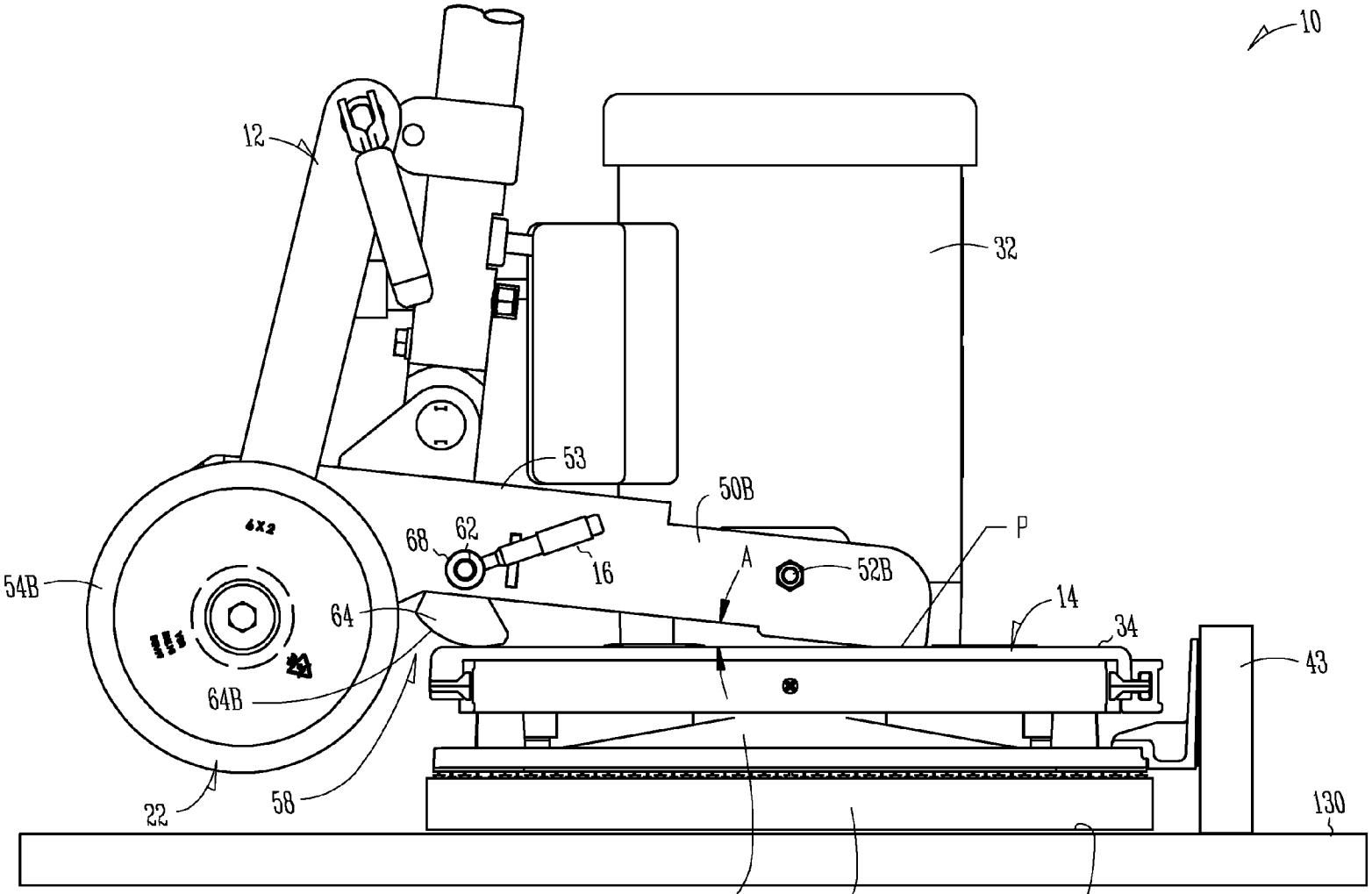
FIG. 7 is a side view of the floor scrubber of FIGS. 1-3 with the wheel lift assembly engaged to tilt a wheel assembly of the truck unit relative to the cleaning head assembly.
Figure 8:
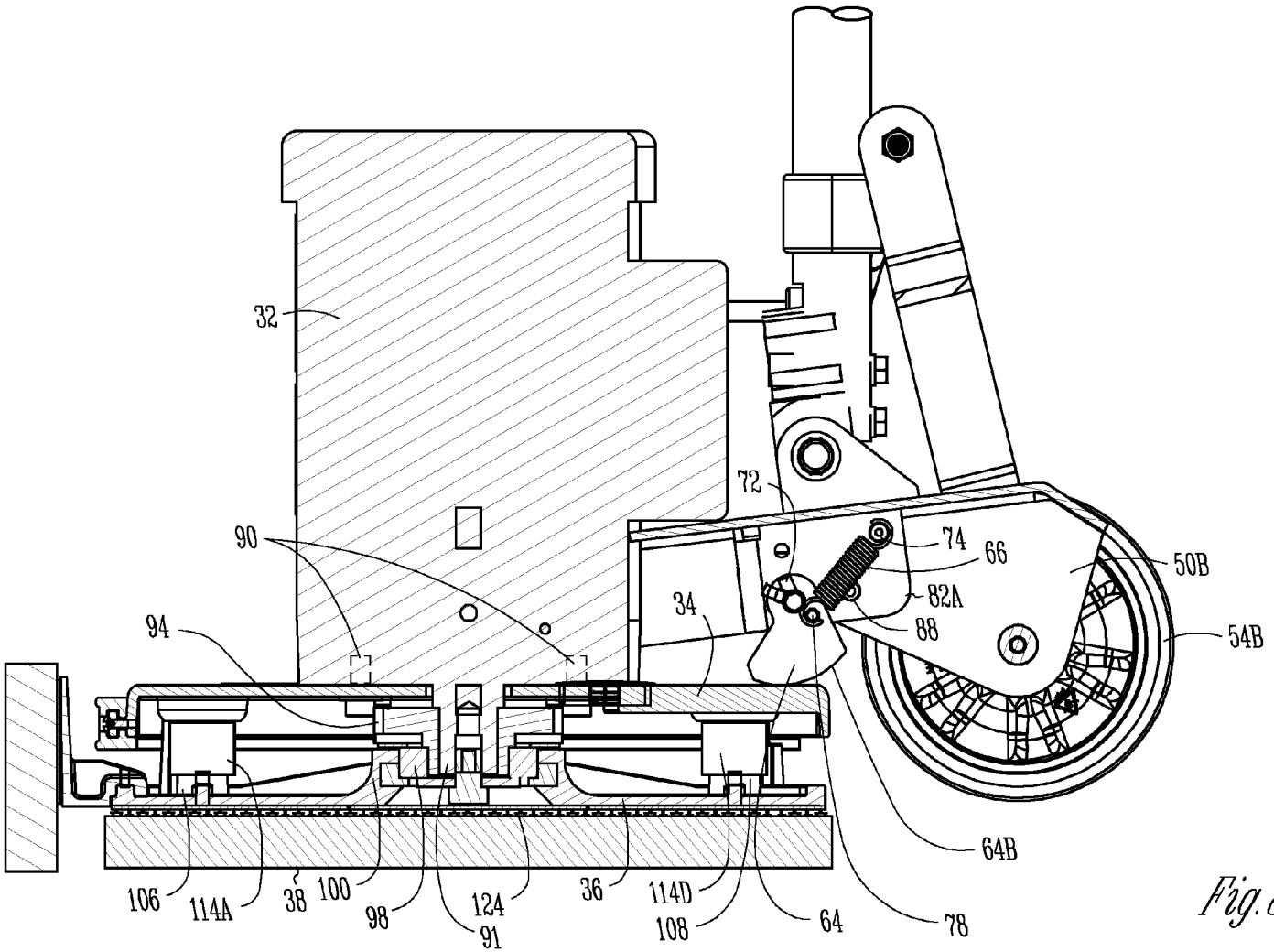
FIG. 8 is a side cross-sectional view of the truck unit of FIG. 7 showing a cam of the wheel lift assembly in an extended position to lift the wheel assembly.
Figure 9:
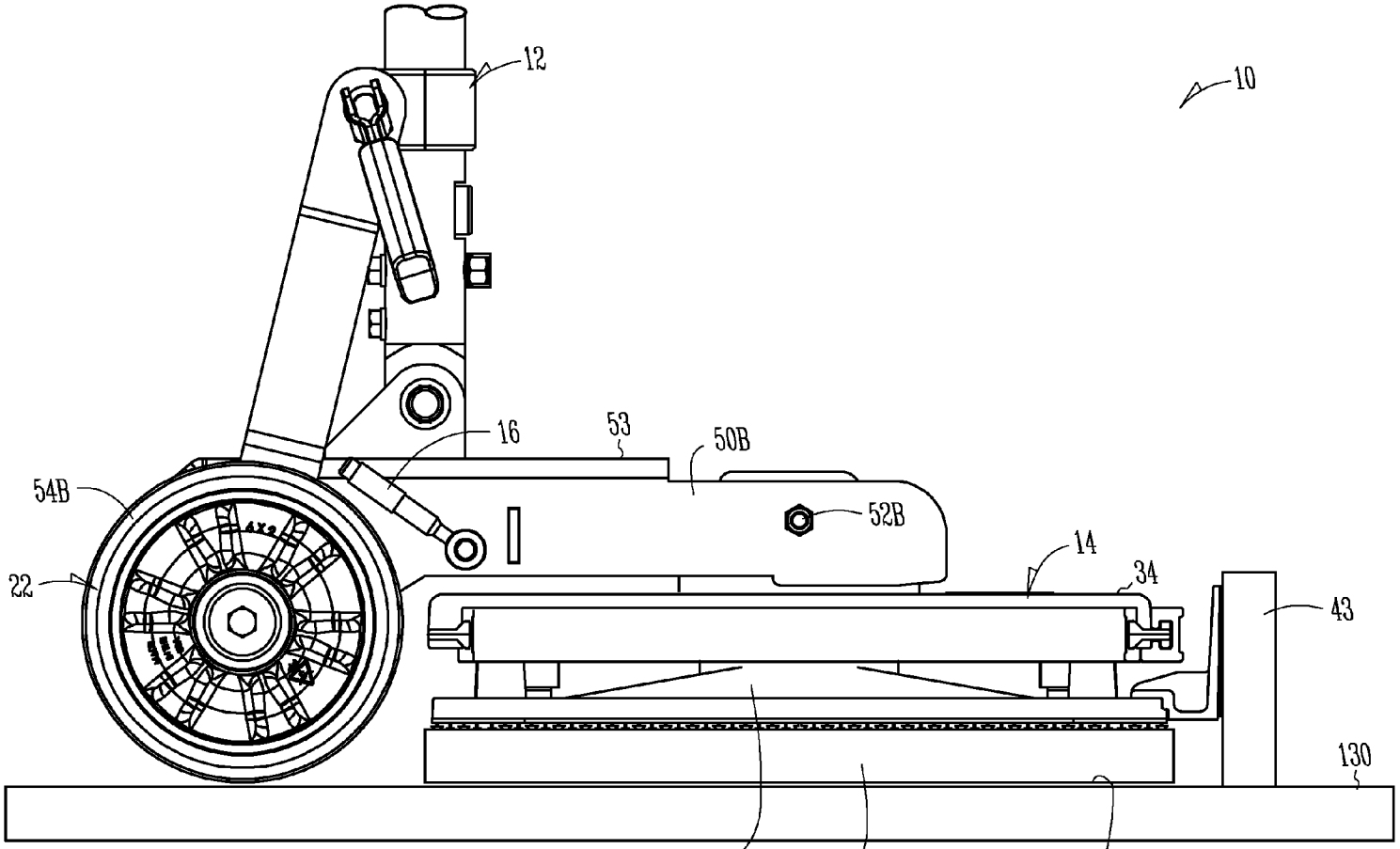
FIG. 9 is a side view of the floor scrubber of FIGS. 1-3 with the wheel lift assembly disengaged to lower the wheel assembly of the truck unit relative to the cleaning head assembly.
Figure 10:
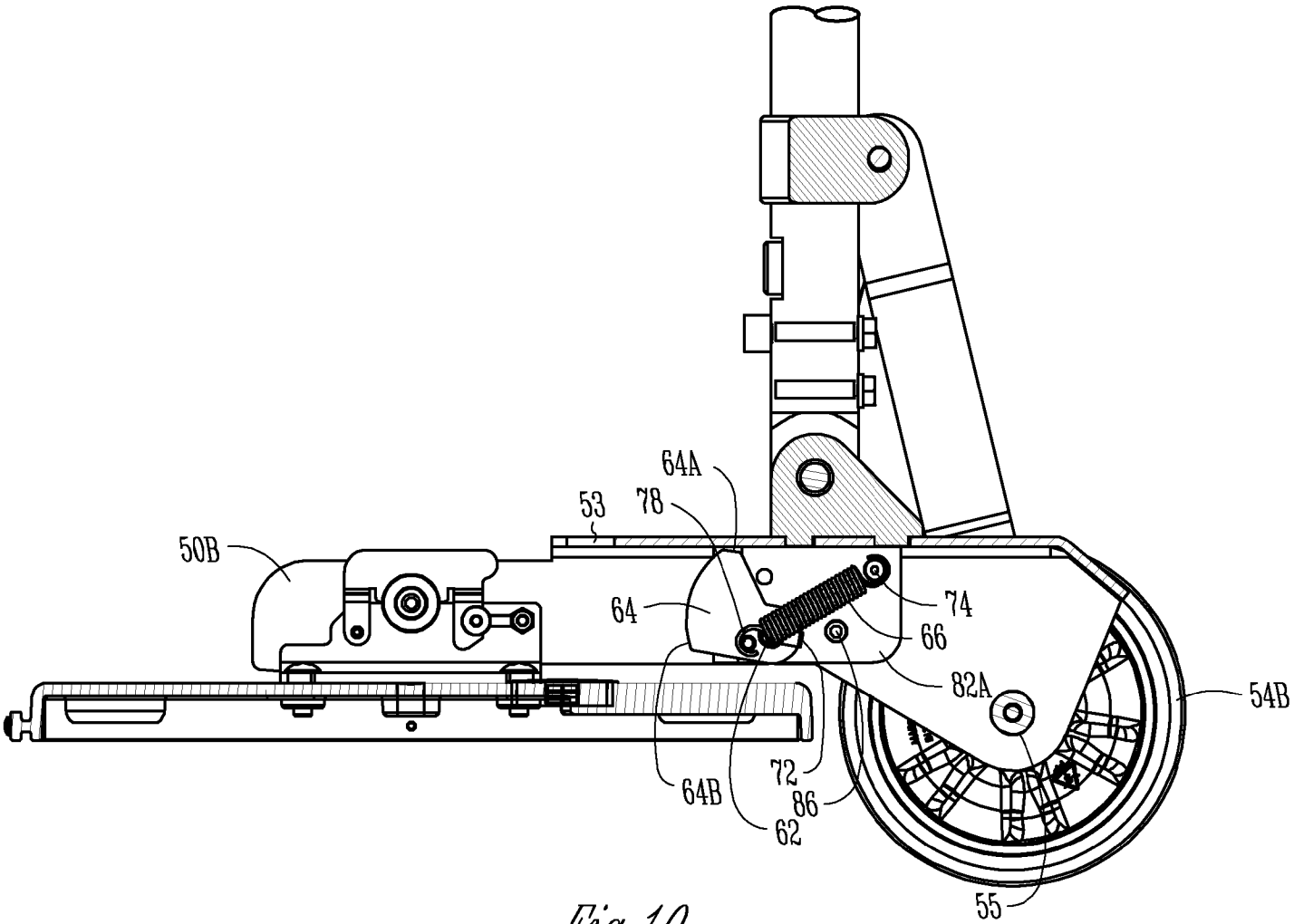
FIG. 10 is a side cross-sectional view of the truck unit of FIG. 5 taken at section 10-10 to show the cam of the wheel lift assembly in a retracted position.

Floor scrubber 10 can comprise a walk-behind floor machine that is operated by the application of manual power to handle bar 26 and steering column 24. Wheel assembly 22 can provide a mechanism for transporting floor scrubber 10, such as by tipping truck unit 12 back using handle bar 26 so cleaning head assembly is propped up by wheel assembly 22. As will be discussed in greater detail below, chassis 20 can pivot on motor mounting plate 34 at brackets 18A and 18B using the aforementioned pivot assemblies. Handle 16 (FIG. 2) can be rotated so that chassis 20 is pivoted away from mounting plate 34 so that wheel assembly 22 is off the ground and pad 38 supports floor scrubber 10 (as shown in FIGS. 7 and 8), or handle 16 can be rotated so that chassis 20 is pivoted toward mounting plate 34 so that wheel assembly 22 and pad 38 support floor scrubber 10 (as shown in FIGS. 9 and 10). The wheels-up position is useful for open or free floor scrubbing where cleaning head assembly is moved in a side-to-side, back-and-forth motion. The wheels-down position is useful for controlling cleaning head assembly 14 in forward and backward linear directions, and is less fatiguing.

Steering column 24 can extend from chassis 20 at bracket 44, which allows steering column 24 to pivot forward and backward in relation to chassis 20. Tilt adjuster 30 can be used to lock steering column 24 in a desired orientation using handle 45. The angle of steering column 24 can be set to a user-desired level for either the wheels-up or wheels-down mode. Steering column 24 can extend to locate handle bar 26 at an ergonomic user-level height. Handle bar 26 can include controls 42A and 42B for operating cleaning head assembly 14, in particular for activating motor 32.

Figure 4A:
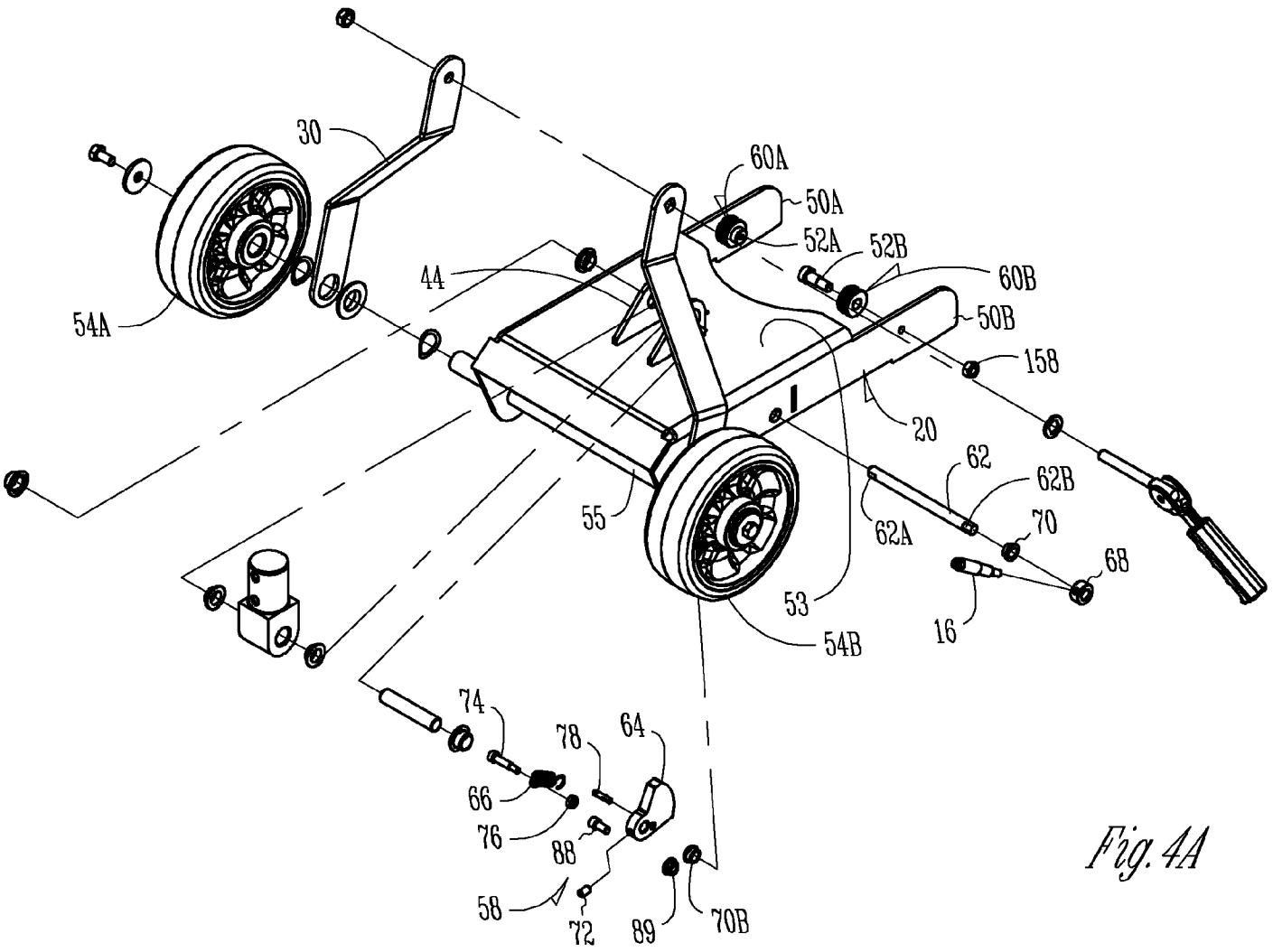
FIG. 4A is an exploded view of the truck unit of FIGS. 1 and 2 showing a truck chassis and components for the wheel lift assembly.
Figure 4B:
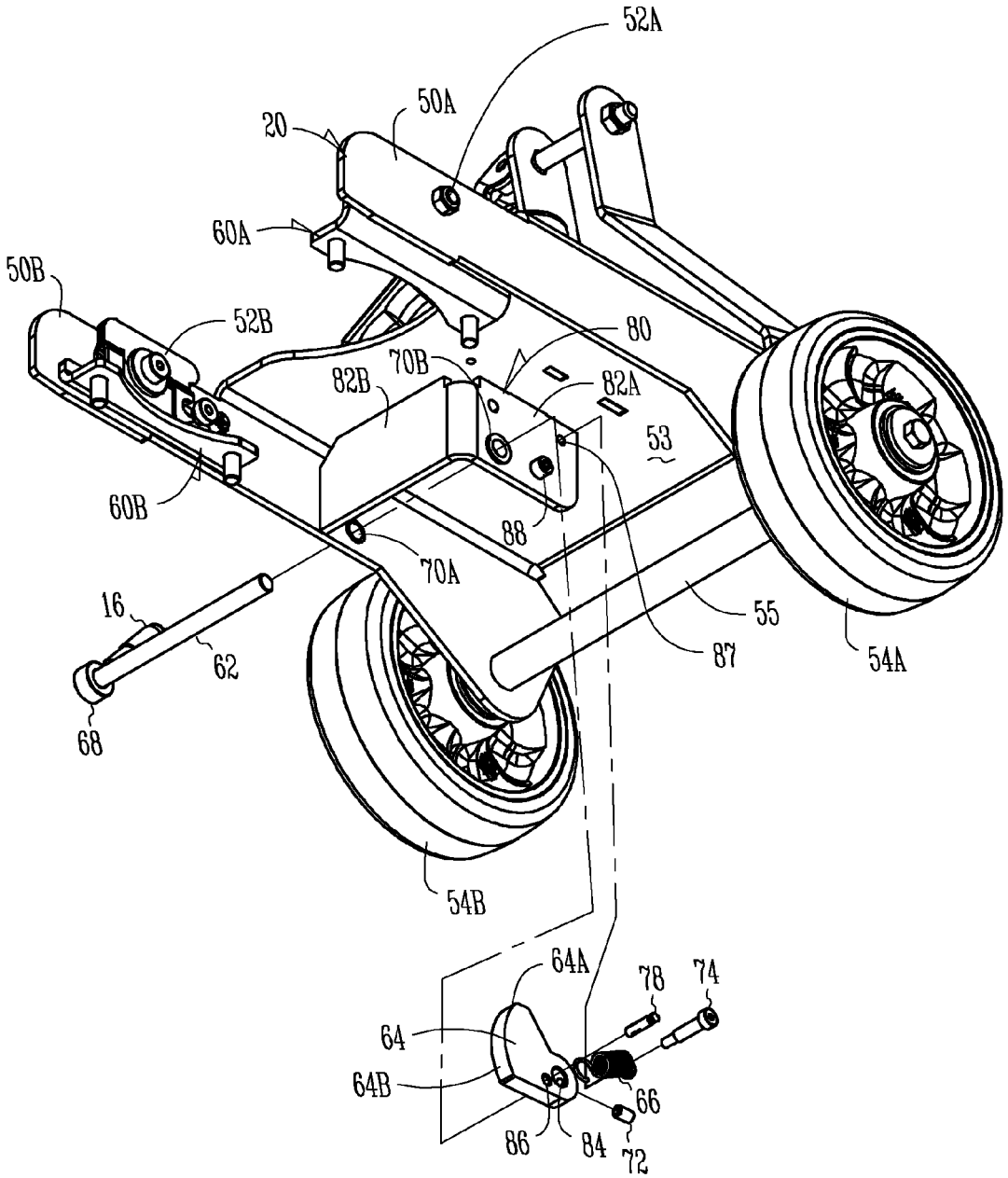
FIG. 4B is a perspective view of the underside of the truck unit of FIG. 4A showing the wheel lift assembly exploded from the chassis.
Figure 4C:
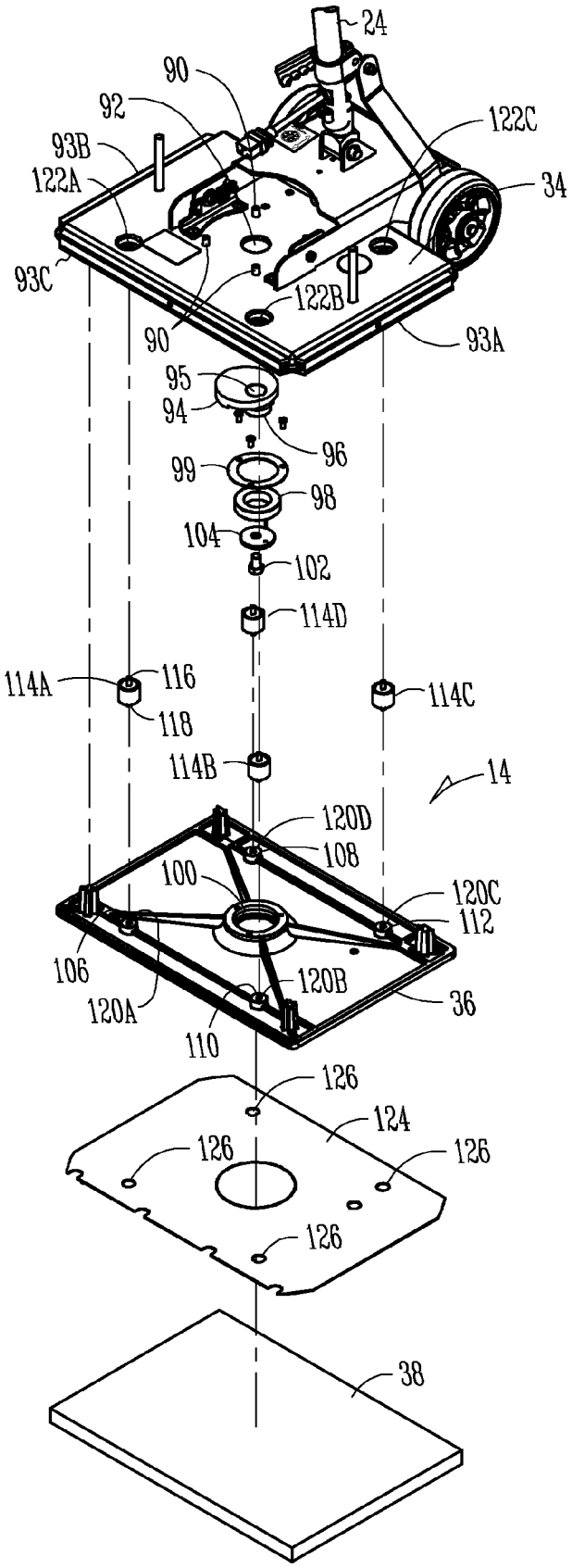
FIG. 4C is an exploded view of the cleaning head assembly of FIGS. 1 and 2 showing components for an orbital scrubbing drive train.

Motor 32 rotates a drive shaft (motor drive shaft 91 of FIG. 8) that is used to oscillate pad drive 36 using an eccentric cam (cam 94 of FIG. 4C). As such, pad 38 can be driven to orbit the drive shaft of motor 32 to provide scrubbing action. Pad 38 can comprise various brushes, stripper pads, eraser pads, scrubber pads, buffer pads or polish pads, as are known in the art. Weights 40 can be positioned on motor mounting plate 34 to apply downward pressure or force to pad 38 to enhance the scrubbing action. Floor scrubber 10 can optionally include baseboard pad 43. Although described with reference to an orbital floor scrubber, the wheel lift mechanism described herein can be used with other floor care and maintenance machines, such as buffers, sanders, polishers and the like, having orbital, rotational or other agitating mechanics.

Figure 3:
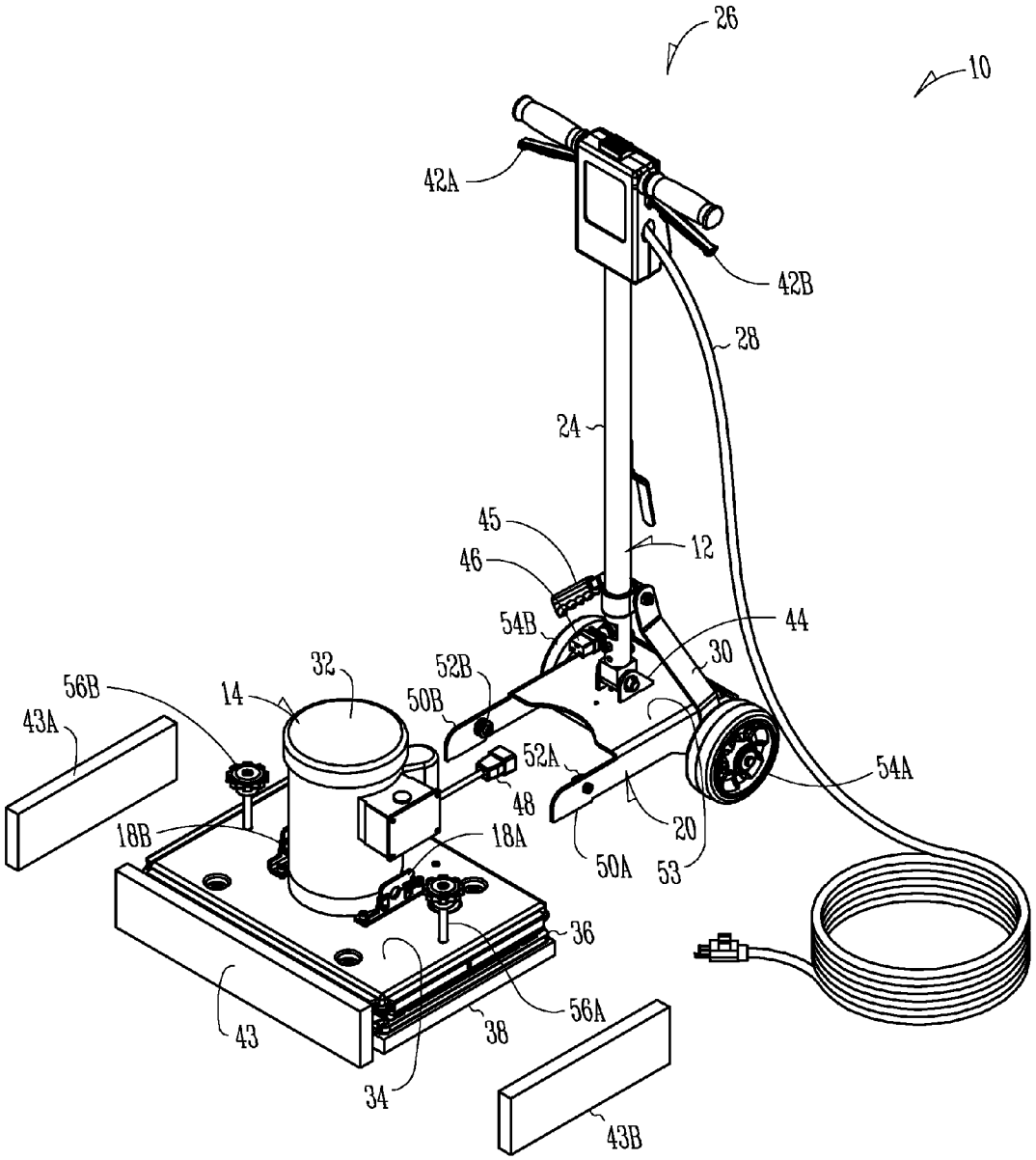
FIG. 3 is an exploded view of the floor scrubber of FIG. 1 showing the cleaning head assembly separated from the truck unit.

FIG. 3 is an exploded view of floor scrubber 10 of FIG. 1 showing cleaning head assembly 14 separated from truck unit 12. As discussed above, truck unit 12 includes chassis 20, wheel assembly 22, steering column 24, handle bar 26, power cord 28 and tilt adjuster 30. Truck unit 12 also includes bracket 44 and power cord adapter 46, which is configured to mate with adapter 48 of motor 32. Chassis 20 includes first rail 50A and second rail 50B, which include first pivot pin 52A and second pivot pin 52B, respectively. Rails 50A and 50B extend from deck 53 to which bracket 44 is mounted. Wheel assembly 22 includes first wheel 54A and second wheel 54B, which are mounted on axle 55 (FIG. 4A). As discussed above, cleaning head assembly 14 includes motor 32, motor mounting plate 34, pad drive 36, pad 38, weights 40 (not shown in FIG. 3), baseboard pad 43 and side pads 43A and 43B. Cleaning head assembly 14 also includes posts 56A and 56B on which weights 40 (FIG. 1) can be mounted. Brackets 18A and 18B extend from motor mounting plate 34.

In order to separate cleaning head assembly 14 from truck unit 12, handle 16 (FIG. 2) can be rotated so that floor scrubber 10 is in the wheels-down position. Brackets 18A and 18B can be unlatched, as discussed with reference to FIGS. 11 and 12, to release pivot pins 52A and 52B and allow motor mounting plate 34 to be withdrawn from between rails 50A and 50B. As such, floor scrubber 10 can be disassembled for transportation and storage, and later reassembled for use after being moved to a desired location.

Figure 11:
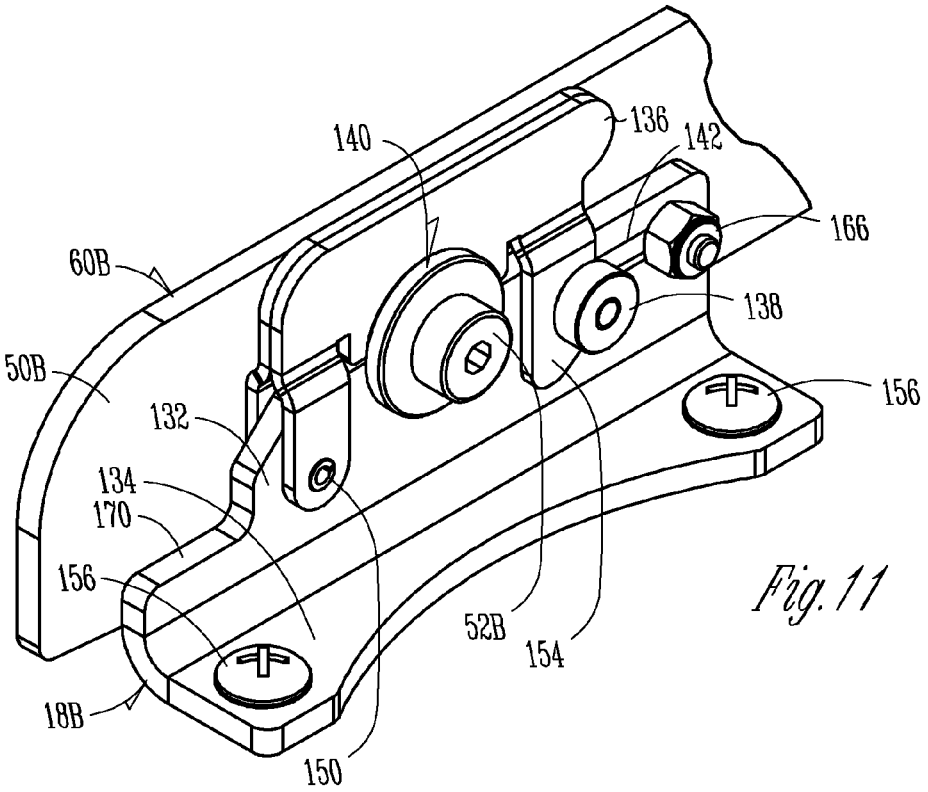
FIG. 11 is a perspective view of a pivot assembly for supporting the cleaning head assembly showing a bracket in a closed position securing a pivot pin of the truck unit.
Figure 12:
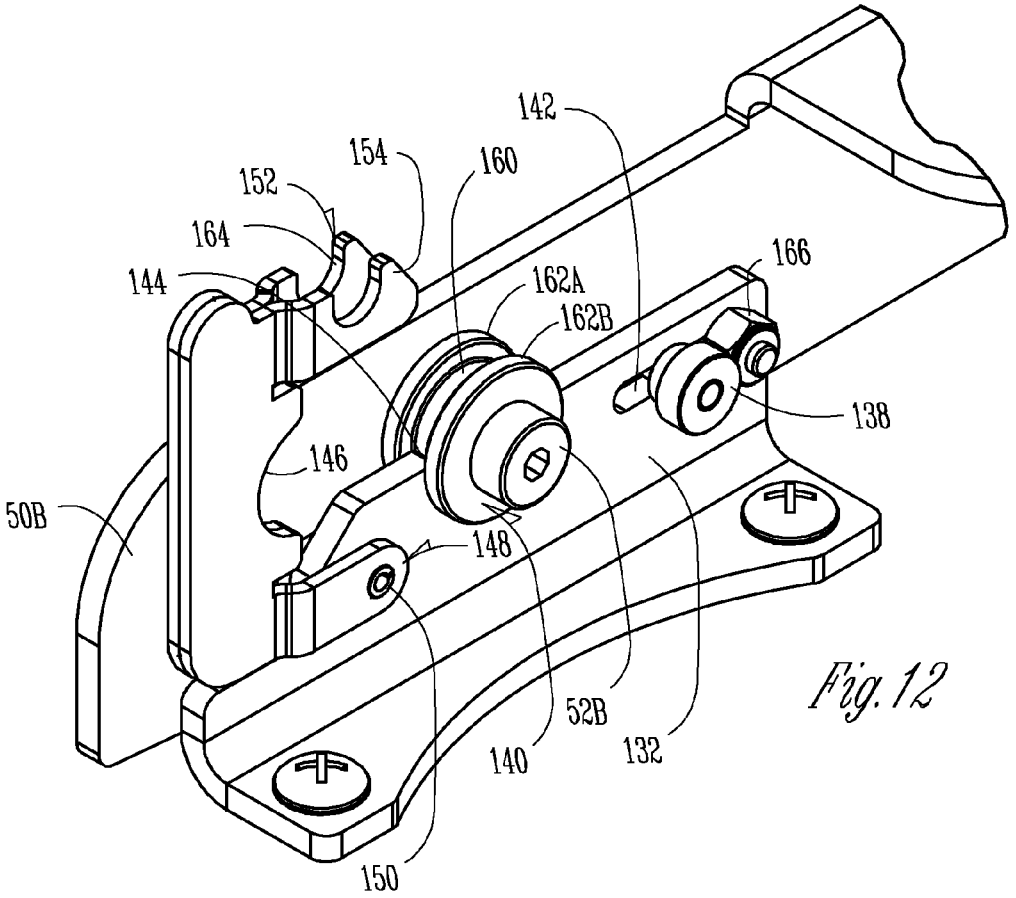
FIG. 12 is a perspective view of the pivot assembly of FIG. 11 showing the bracket in an open position releasing the pivot pin.

FIG. 4A is an exploded view of a lower portion of truck unit 12 of floor scrubber 10 of FIGS. 1 and 2 showing components for wheel lift assembly 58 and pivot assemblies 60A and 60B (see FIGS. 11 and 12). FIG. 4B is a perspective view of the underside of truck unit 12 of FIG. 4A showing wheel lift assembly 58 exploded from chassis 20. Wheel lift assembly 58 includes handle 16, shaft 62, cam 64, spring 66, collar 68, bushings 70A and 70B, set screw 72, fastener 74, nut 76 (FIG. 4A) and pin 78. As can be seen in FIG. 4B, wheel lift assembly 58 can be mounted on bracket 80 connected to the underside of chassis 20.

Bracket 80 can include first panel 82A that can be disposed parallel to rails 50A and 50B, and second panel 82B, which can be angled from first portion 82. Second panel 82B can extend from first panel 82A to provide stability and can further engage rail 50B to provide additional stability. First panel 82A can be positioned between rails 50A and 50B and, along with rail 50B, can provide a mounting location for shaft 62.

Shaft 62 can be configured to extend through bore 84 within cam 64, while being supported at bushings 70A and 70B on rail 50B and first panel 82A, respectively. Set screw 72 can be threaded into a threaded bore in cam 64 that penetrates into bore 84. Thus, set screw 72 can be advanced into the threaded bore to engage flat 62A on shaft 62. Similarly, handle 16 can be threaded into collar 68 to engage flat 62B on shaft 62. Flats 62A and 62B additionally ensure that cam 64 and handle 16 mount on shaft 62 in the desired orientation, e.g. by engaging with correspondingly shaped (D-shaped) bores in cam 64 and collar 68. Thus, flats 62A and 62B rotated from each other by a desired amount of degrees relative to the circumference of shaft 62 in order to allow handle 16 to be in the back position while cam 64 is in the retraced position.

Pin 78 can be configured to extend into bore 86 in cam 64 to support spring 66. Fastener 74 can be configured to extend into bore 87 in first panel 82A to support spring 66. Spring 66 can be connected to pin 78 and fastener 74 in order to pull cam 64 upwards toward chassis 20. As such, end surface 64A can engage deck 53 to stop further upward rotation of cam 64. As will be discussed in greater detail below, handle 16 can be actuated to cause rotation of shaft 62 so that cam 64 is rotated downward toward cleaning head assembly 14 (FIG. 3). As such, cam surface 64B will engage motor mounting plate 34 (FIG. 3) to cause rotation at pivot assemblies 60A and 60B. The distance between cam surface 64B and the center of bore 84 varies (e.g. increases) along the arc of cam surface 64B to push motor mounting plate 34 further away as cam 64 is advanced further downward. Fastener 88 can be configured to extend through panel 82A and can be secured using nut 89 (FIG. 4A) to provide a stop to prevent further downward rotation of cam 64.

Wheels 54A and 54B can be mounted on axle 55, which is supported by flanges extending from rails 50A and 50B. Wheels 54A and 54B can provide clearance for mounting cleaning head assembly 14 underneath rails 50A and 50B at pivot pins 52A and 52B. Pivot assemblies 60A and 60B, which can be connected to motor mounting plate 34, are shown in FIG. 4B to illustrate the pivoting relationship with rails 50A and 50B.

FIG. 4C is an exploded view of various components of cleaning head assembly 14, including motor mounting plate 34, pad drive 36 and pad 38. Motor 32 (FIG. 3) is mounted to motor mounting plate 34 at studs 90 such that drive shaft 91 (FIG. 8) of motor 32 extends through bore 92. Motor mounting plate 34 has left lip 93A, right lip 93B and front lip 93C formed at the outer extremities of mounting plate 34. These lips add rigidity to motor mounting plate 34 and protect the components housed thereunder, such as pad driver 38.

Motor 32 causes drive shaft 91 to rotate. Drive shaft 91 is coupled to eccentric cam 94 at bore 95, which is located off of the center of eccentric cam 94. Extension shaft 96 extends from and can be integral with eccentric cam 94. Ball bearing assembly 98 is pressed to fit in journal 100 in pad driver 36. Ball bearing assembly 98 can be secured to pad driver 36 using washer 99. Extension shaft 96 contacts the inside raceway of ball bearing assembly 98. Fastener 102 passes through washer 104 and threadably engages a hole (not shown) in motor drive shaft 91 extension shaft 96. When motor 32 is powered on, such as by the supplying of electric power from cord 28 when controls 42A and 42B are activated, motor drive shaft 91 rotates eccentric cam 94, which imparts orbital movement to pad driver 36 because of the off-center position of drive shaft 91 in eccentric cam 94. In other words, drive shaft 91 and extension shaft 96 are not in alignment, which imparts the orbital movement to pad driver 36. Drive shaft 91, eccentric cam 94 and bearing assembly 98 and journal 100 thereby form an orbital scrubbing drivetrain.

Pad driver 36 forms a left front mounting pedestal 106, left rear mounting pedestal 108, right front mounting pedestal 110, and right rear mounting pedestal 112. Lower vibration dampening element 114A has upper threaded shaft 116A extending from the top thereof and lower threaded shaft 118A extending from the bottom of vibration dampening element 114A. Lower threaded shaft 118A threadably engages threaded hole 120A in left front mounting pedestal 106. Upper threaded shaft 116 passes through hole 122A in motor mounting plate 34 and engages a nut (not shown). Lower vibration damping elements 114B, 114C and 114D have similar features to similarly pass through holes 120B, 120C and 120D, as well as holes 122B, 122C and 122D (see FIG. 6), respectively.

Pad grip 124 comprises a material that can be used to engage pad 38. For example, pad grip 124 may comprise hook and loop fastener material that interfaces with mating material on the back of pad 38. Pad grip 124 can be attached to pad driver 36 using adhesive or any suitable means, such as threaded fasteners extending through holes 126 to engage holes 120A-120D in pad driver 36. As discussed above, pad 38 can have any one of a number of different floor treatment surfaces, including pads for polishing, scrubbing, abrading or buffing. In another example, pad 38 can be replaced with a brush or the like.

Figure 5:
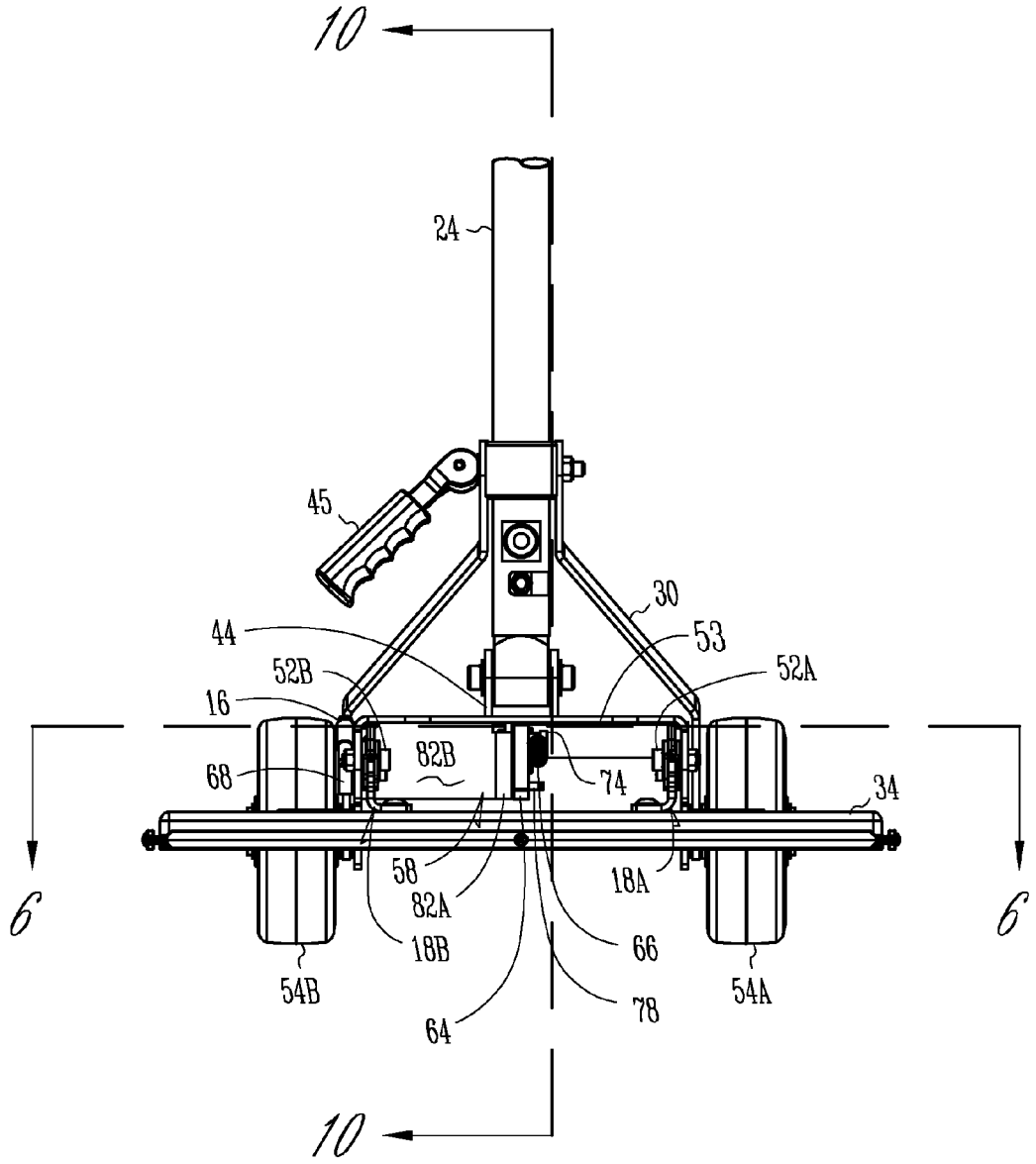
FIG. 5 is a front view of the truck unit of FIG. 4C with a motor of the cleaning head assembly removed to show the wheel lift assembly within the truck chassis.
Figure 6:
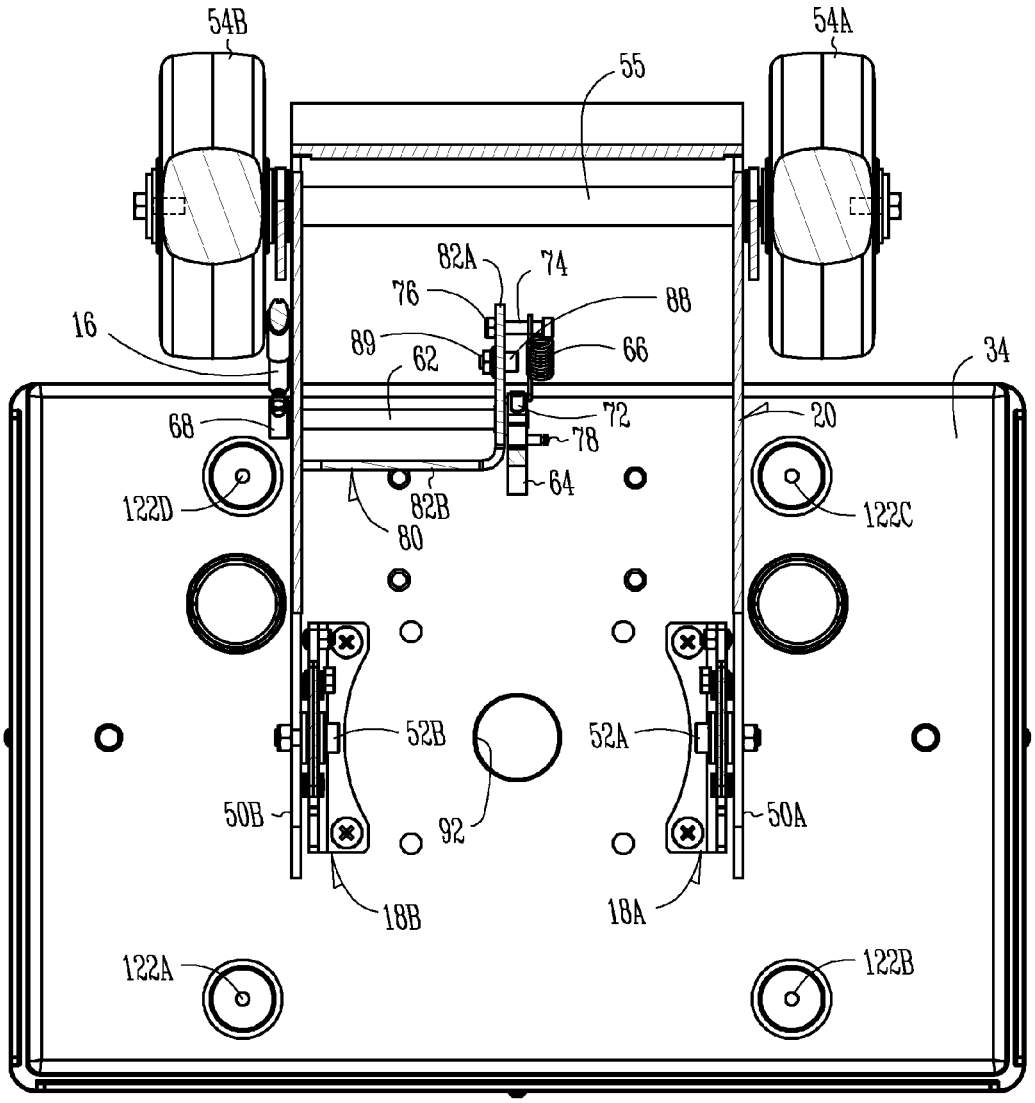
FIG. 6 is a top cross-sectional view of the truck unit of FIG. 5 taken at section 6-6 to show the wheel lift assembly within the chassis of the truck unit.

FIG. 5 is a front view of truck unit 12 of FIG. 4C with motor 32 of cleaning head assembly 14 removed to show wheel lift assembly 58. FIG. 6 is a top cross-sectional view of truck unit 12 of FIG. 5 taken at section 6-6 to show wheel lift assembly 58 within chassis 20 of truck unit 12.

Shaft 62 extends through bore 84 (FIG. 4B) in cam 64. Bushings 70A and 70B surround shaft 62 within bores in rail 50B and first panel 82A of bracket 80, respectively. Cam 64 can be secured to shaft 62 using set screw 72. Set screw 72 can be threaded into a bore in cam 64 that is disposed perpendicular to the axis of shaft 62 to penetrate into bore 84 and engage shaft 62. Set screw 72 can prevent rotation of cam 64 about shaft 62. Handle 16 can be connected to shaft 62 using collar 68. Shaft 62 can be threaded into collar 68, while handle 16 can be threaded into a bore disposed in collar 68 perpendicular to shaft 62 so as to provide a lever. Thus, handle 62 can be pivoted to rotate shaft 62 and cam 64 underneath deck 53 of chassis 20.

Fastener 74 and nut 76 are used to connect spring 66 to bracket 80 under deck 53. Fastener 74 extends into bore 87 (FIG. 4B) in panel 82A. Nut 76 can be threaded onto the tip of fastener 74 extending through panel 82A. Pin 78 is used to connect spring 66 to cam 64. Pin 78 can be coupled to bore 86 (FIG. 4B) in cam 64 via a force fit or interference fit. Spring 66 can then be secured to pin 78 and fastener 74. Spring 66 can be configured to bias cam 64 toward deck 53. Fastener 88 and nut 89 can be connected to panel 82A to prevent over-rotation of cam 64 away from deck 53.

FIG. 7 is a side view of floor scrubber 10 of FIGS. 1 and 2 with wheel lift assembly 58 engaged to tilt wheel assembly 22 of truck unit 12 relative to cleaning head assembly 14. FIG. 8 is a side cross-sectional view of truck unit 12 of FIG. 7 showing cam 64 of wheel lift assembly 58 in a fully-extended position to lift wheel assembly 22.

Handle 16 can be rotated forward, toward motor 32, so that cam 64 is rotated forward on shaft 62 to overcome the force of spring 66. Pin 78 can be positioned on cam 64 such that the force of spring 66 can be used to hold cam 64 in the extended position after overcoming the spring force from the retracted position. For example, spring 66 can hold cam 64 in the retracted position, the spring force can be overcome to rotate cam 64 to the extended position, and a spring force can again be generated to stabilize the position of cam 64 in the extended position. Cam 64 can be rotated to extend from the space between rails 50A and 50B so that cam surface 64B engages motor mounting plate 34. As such, rail 50B and rail 50A (FIG. 6) can become angled with respect to motor mounting plate 34 as truck unit 12 rotates on pivot pins 52B and 52A (FIG. 6). In one example, angle A of approximately five degrees can be formed when cam 64 is rotated fully forward. In other examples, angle A can be within the range of four degrees to six degrees. Rails 50A and 50B can be angled sufficiently so that wheels 54A and 54B of wheel assembly 22 are raised above the lower most surface 128 of pad 38, which rests on floor 130. Fastener 88 can be positioned on panel 82A to prevent undesirable advancement of cam 64. Additionally, motor mounting plate 34 can serve as a hard stop against the rotation of rails 50A and 50B at contact point P. Thus, the amount of rotation between motor mounting plate 34 and rails 50A and 50B can be controlled by the distance between motor mounting plate 34 and rails 50A and 50B, as well as the lengths of rails 50A and 50B that extend beyond pivot pins 52A and 52B towards pad 43. The geometry of cam 64, particularly cam surface 64B, can be such that, when rotated forward, frictional engagement of cam 64, such as provided by the weight of motor 32 and cleaning head assembly 14, with motor mounting plate 34 overcomes the force of spring 66, which acts to rotate cam 64 into a retracted position. In such a position, wheels 54A and 54B do not interfere with cleaning head assembly 14 or interfere with the trajectory of floor scrubber 10 during operation. In such a position, cleaning head assembly is said to be "floating" on pad 38, and movement of cleaning head assembly 14 is uninhibited.

FIG. 9 is a side view of floor scrubber 10 of FIGS. 1 and 2 with wheel lift assembly 58 disengaged to lower wheel assembly 22 of truck unit 12 relative to cleaning head assembly 14. FIG. 10 is a side cross-sectional view of truck unit 12 of FIG. 5 taken at section 10-10 to show cam 64 of wheel lift assembly 58 in a fully-retracted position.

Handle 16 can be rotated rearward, toward wheel assembly 22, so that cam 64 is rotated rearward on shaft 62 to be disengaged from motor mounting plate 34. Cam 64 can be rotated to be retracted into the space between rails 50A and 50B so that end surface 64A engages deck 53. As such, rail 50B and rail 50A (FIG. 6) can become disposed parallel to motor mounting plate 34 as truck unit 12 rotates on pivot pins 52B and 52A (FIG. 6). Pivot pins 52B and 52A are located in the middle of pad drive 36 between forward and aft faces so that pad 38 is suspended parallel to floor 130 when rails 50A and 50B are parallel to floor 130. Wheels 54B and 54A (FIG. 6) of wheel assembly 22 can become positioned below lower most surface 128 of pad 38, as shown in FIG. 9, so as to be able to engage floor 130. In other examples, wheel 54B can be positioned at or above lower most surface 128 of pad 38 in the fully-retracted position. Spring 66 is configured to pull cam 64 back to the retracted position. In such a position, wheels 54A (FIG. 4A) and 54B provide support to cleaning head assembly 14 and guide cleaning head assembly 14 along a straight path in the direction that wheels 54A and 54B are configured to roll on axle 55. Wheels 54A and 54B help resist the multi-directional scrubbing movement of pad drive 36, which tends to pull floor scrubber 10 along in various directions as an operator attempts to linearly displace the machine.

Chassis 20 can be advanced to intermediate positions between the fully-extended and fully-retraced positions that generate the wheels-up and wheels-down positions, respectively, in order to adjust the height of wheels 54A and 54B. Specifically, an operator of floor scrubber 10 can manually induce rotation of chassis 20 relative to motor mounting plate 34, without the aid of cam 64 by pushing on handle bar 26. As such, wheels 54A and 54B can be lifted to any desirable height until rails 50A and 50B engage motor mounting plate 34 at contact point P (FIG. 7). As such, the operator can manually control how much of the weight of cleaning head assembly rests on wheels 54A and 54B versus resting on pad 38. Lifting wheels 54A and 54B, either manually or with the aid of cam 64, is useful for engaging baseboard pad 43 with a baseboard. Lowering wheels 54A and 54B can be useful for engaging side pads 43A and 43B with baseboard, wherein wheels 54A and 54B will assist in guiding pad 38 parallel to a baseboard of a floor surface, particularly in a corner where two baseboards meet.

FIG. 11 is a perspective view of pivot assembly 60B showing bracket 18B in a closed position securing pivot pin 52B. FIG. 12 is a perspective view of pivot assembly 60B of FIG. 11 showing bracket 18B in an open position releasing pivot pin 52B. Pivot assembly 60B is shown and described with reference to FIGS. 11 and 12, but pivot assembly 60B can include similar components that operate similarly in conjunction with rail 50A and pivot pin 52A.

Bracket 18B includes base 132, flange 134, latch 136 and pin 138. Pivot pin 52B includes bushing 140. Base 132 includes slot 142 and first cutout 144 (FIG. 12). Latch 136 includes second cutout 146 (FIG. 12), first end 148 with pin 150, and second end 152 with hook 154 (FIG. 12).

Pivot pin 52B can comprise a fastener that passes through rail 50B to receive nut 158 (FIG. 4A). Bushing 140 can comprise a flanged washer having central portion 160 that surrounds pivot pin 52B, and flanges 162A and 162B that extend from central portion 160 to receive first cutout 144 and second cutout 146.

Flange 134 can be attached to motor mounting plate 34 (FIG. 2) using any suitable connection, such as fasteners 156. Base 132 extends from flange 134 and provides a connection point for receiving pivot pin 52B. Specifically, first cutout 144 can have a semi-circular shape to receive bushing 140. Likewise, second cutout 146 can have a semi-circular shape to receive bushing 140 when latch 136 is rotated at pin 150 to engage base 132. Pivot pin 52B extends perpendicularly from rail 50B and base 132 extends parallel to rail 50B so that base 132 and latch 136 are rotatable around pivot pin 52B within flanges 162A and 162B.

As shown in FIG. 11, when latch 136 is rotated at pin 150 so hook 154 engages base 132, pin 138 can be slid (to the left in FIG. 11) to engage notch 164 on hook 154. In one example, fastener 166 can be used to secure a spring (not shown) within slot 142 to bias pin 138 to engage with hook 154. As such, latch 136 will be inhibited from opening and base 132 will be suspended from pivot pin 52B via latch 136. Pivot pin 52A similarly interacts with bracket 18A (FIG. 5). As such, motor mounting plate 34 and cleaning head assembly 14 can be suspended from rails 50A and 50B (FIG. 2).

In order to remove cleaning head assembly 14 from chassis 20 of truck unit 12, latch 136 is opened to release pivot pin 52B, as shown in FIG. 12. Pin 138 is pushed away from pivot pin 52B (to the right in FIG. 12), overcoming any biasing force applied by a spring (not shown) held in slot 142 by fastener 166. Pin 138 is removed from notch 164 in hook 154, freeing second end 152. First end 140 of latch 136 can be rotated at pin 150 to separate second end 152 from base 132. Base 132 includes cutout 170 that permits latch 136 to be fully rotated to a position perpendicular to base 132. With latch 136 fully rotated, as shown in FIG. 12, second cutout 146 is displaced from first cutout 144 so that a path for pivot pin 52B to be removed from base 132 is cleared. Wheel assembly 22 can be rotated into the wheels-down position before opening latches 18A and 18B and removing cleaning head assembly 14 from truck unit 12.

Various Notes & Examples

Example 1 can include subject matter such as an apparatus, such as can include a floor treating apparatus comprising: a chassis having a wheel assembly and a handle assembly; a cleaning head assembly having a motor mounting plate suspended from the chassis at pivot points; and a wheel lift assembly having a cam mounted between the chassis and the motor mounting plate, and a lever for rotating the cam to tilt the motor mounting plate on the pivot points.

Example 2 can include, or can optionally be combined with the subject matter of Example 1, to optionally include a cam that can be rotated from a first position disengaged from the motor mounting plate to a second position pushing the motor mounting plate away from the chassis.

Example 3 can include, or can optionally be combined with the subject matter of any of the preceding examples 1-2, to optionally include a cam mounted to the chassis above the motor mounting plate.

Example 4 can include, or can optionally be combined with the subject matter of any of the preceding examples 1-3, to optionally include a wheel lift assembly further comprising a spring to bias the cam to the first position.

Example 5 can include, or can optionally be combined with the subject matter of any of the preceding examples 1-4, to optionally include a chassis comprising first and second pivot points disposed on a pivot axis that is parallel to a surface being treated.

Example 6 can include, or can optionally be combined with the subject matter of any of the preceding examples 1-5, to optionally include a chassis comprising a deck, a first rail extending from the deck, a second rail extending from the deck spaced from the first rail, a first pivot pin disposed on the first rail to form the first pivot point, and a second pivot pin disposed on the second rail to form the second pivot point.

Example 7 can include, or can optionally be combined with the subject matter of any of the preceding examples 1-6, to optionally include a cam that is retracted between the first and second rails in the first position and extended beyond the first and second rails in the second position.

Example 8 can include, or can optionally be combined with the subject matter of any of the preceding examples, 1-7 to optionally include a support bracket mounted underneath the deck between the first and second rails, and a shaft extending from the first rail to the support bracket, wherein the lever extends from the shaft outside the chassis and the cam extends from the shaft proximate the support bracket.

Example 9 can include, or can optionally be combined with the subject matter of any of the preceding examples 1-8, to optionally include brackets for suspending the motor mounting plate, each bracket including a lock mechanism for attaching to and releasing from one of the first and second pivot points.

Example 10 can include, or can optionally be combined with the subject matter of any of the preceding examples 1-9, to optionally include a lock mechanism comprising: a base having a first cutout for receiving a pivot pin and a slot having a lock pin, and a latch having a second cutout for receiving the pivot pin, a first end pivotably connected to the base, and a second end having a hook for engaging the lock pin.

Example 11 can include, or can optionally be combined with the subject matter of any of the preceding examples 1-10, to optionally include a cleaning head assembly further comprising a motor mounted to the motor mounting plate and a pad drive coupled to the motor.

Example 12 can include, or can optionally be combined with the subject matter of any of the preceding examples 1-11, to optionally include an eccentric cam connecting the motor and the pad drive.

Example 13 can include, or can optionally be combined with the subject matter of any of the preceding examples 1-12, to optionally include a motor mounting plate that is suspended at a pivot axis located approximately equidistant from a front edge and a rear edge of the pad drive.

Example 14 can include, or can optionally be combined with the subject matter of any of the preceding examples 1-13, to optionally include a pair of wheels connected to the chassis at an axle and a pad mounted to the pad drive, wherein the pair of wheels are lifted relative to the motor mounting plate so that the weight of the floor scrubber rests solely on the pad when the cam is in the second position.

Example 15 can include subject matter such as an apparatus, such as can include a floor scrubber comprising: a wheel assembly including a pair of wheels mounted to a chassis; a cleaning head assembly having a motor mounting plate pivotably coupled to the chassis, a motor mounted to the motor mounting plate, and a cleaning pad drive coupled to the motor; and a lift assembly configured to change an angle between the motor mounting plate and the chassis.

Example 16 can include, or can optionally be combined with the subject matter Example 15, to optionally include a pad mounted to the cleaning pad drive, wherein the lift assembly is configured to lift the pair of wheels above a lowest point of the pad.

Example 17 can include, or can optionally be combined with the subject matter of any of the preceding examples 15-16, to optionally include a lift assembly including a cam that wedges between the motor mounting plate and the chassis to cause rotation about a pivot axis between the motor mounting plate and the chassis.

Example 18 can include, or can optionally be combined with the subject matter of any of the preceding examples 15-17, to optionally include a pair of brackets connected to the motor mounting plate that releasably couple to a pair of pins connected to the chassis, the pair of pins defining the pivot axis.

Example 19 can include, or can optionally be combined with the subject matter of any of the preceding examples 15-18, to optionally include a cleaning pad drive that is coupled to the motor via an eccentric cam.

Example 20 can include subject matter such as an apparatus, such as can include a truck unit comprising: a chassis comprising a deck, and first and second rails extending from the deck; a pair of wheels mounted to the chassis proximate a first end of the first and second rails; first and second pivot pins mounted to the first and second rails, respectively, proximate a second end of the first and second rails; a cam shaft supported by the first or the second rail between the first and second ends; a cam mounted to the cam shaft between the first and second rails; and a lever connected to the cam shaft outside of the chassis.

Example 21 can include, or can optionally be combined with the subject matter of Example 20, to optionally include a spring connected to the cam and the chassis to bias the cam in a position between the first and second rails.

Example 22 can include, or can optionally be combined with the subject matter of any of the preceding examples 20-21, to optionally include a lever that is configured to rotate the cam shaft to extend the cam out from between the first and second rails.

Example 23 can include, or can optionally be combined with the subject matter of any of the preceding examples 20-22, to optionally include a motor mounting plate coupled to the first and second pivot pins at first and second brackets having first and second latches.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

What is claimed is:

1. A floor treating apparatus comprising:
- a chassis having a wheel assembly and a handle assembly;
- a cleaning head assembly comprising:
  - a motor mounting plate suspended from the chassis at pivot points; and
- a wheel lift assembly comprising:
  - a cam mounted between the chassis and the motor mounting plate; and
  - a lever for rotating the cam to tilt the motor mounting plate on the pivot points.

2. The floor treating apparatus of claim 1, wherein the cam can be rotated from a first position disengaged from the motor mounting plate to a second position pushing the motor mounting plate away from the chassis.

3. The floor treating apparatus of claim 2, wherein the cam is mounted to the chassis above the motor mounting plate so that the cam can act on an u e surface of the motor mounting plate.

4. The floor treating apparatus of claim 2, wherein the wheel lift assembly further comprises a spring to bias the cam to the first position.

5. The floor treating apparatus of claim 4, wherein the chassis comprises first and second pivot points disposed on a pivot axis that is parallel to a surface being treated.

6. The floor treating apparatus of claim 5, wherein the chassis comprises:
- a deck;
- a first rail extending from the deck;
- a second rail extending from the deck spaced from the first rail;
- a first pivot pin disposed on the first rail to form the first pivot point; and
- a second pivot pin disposed on the second rail to form the second pivot point.

7. The floor treating apparatus of claim 6, wherein the cam is retracted between the first and second rails in the first position so as to be above a lower surface of the first and second rails, and extended beyond the lower surface of the first and second rails in the second position.

8. The floor treating apparatus of claim 7, further comprising:
- a support bracket mounted underneath the deck between the first and second rails; and
- a shaft extending from the first rail to the support bracket; wherein the lever extends from the shaft outside the chassis and the cam extends from the shaft proximate the support bracket.

9. The floor treating apparatus of claim 5, wherein the motor mounting plate is suspended by brackets that each include a lock mechanism for attaching to and releasing from one of the first and second pivot points.

10. The floor treating apparatus of claim 9, wherein the lock mechanism comprises:
- a base comprising:
  - a first cutout for receiving a pivot pin; and
  - a slot having a lock pin; and
- a latch comprising:
  - a second cutout for receiving the pivot pin;
  - a first end pivotably connected to the base; and
  - a second end having a hook for engaging the lock pin.

11. The floor treating apparatus of claim 2, wherein the cleaning head assembly further comprises:
- a motor mounted to the motor mounting plate; and
- a pad drive coupled to the motor.

12. The floor treating apparatus of claim 11, further comprising an eccentric cam connecting the motor and the pad drive.

13. The floor treating apparatus of claim 11, wherein the motor mounting plate is suspended at a pivot axis located approximately equidistant from a front edge and a rear edge of the pad drive.

14. The floor treating apparatus of claim 11, further comprising:
- a pair of wheels connected to the chassis at an axle; and
- a pad mounted to the pad drive; wherein the pair of wheels are lifted relative to the motor mounting plate so that the weight of the floor scrubber rests solely on the pad when the cam is in the second position.

15. A floor scrubber comprising:
- a wheel assembly including a pair of wheels mounted to a chassis;
- a cleaning head assembly comprising:
  - a motor mounting plate pivotably coupled to the chassis;
  - a motor mounted to the motor mounting plate; and
  - a cleaning pad drive coupled to the motor; and
- a lift assembly configured to change an angle between the motor mounting plate and the chassis.

16. The floor scrubber of claim 15, further comprising a pad mounted to the cleaning pad drive, wherein the lift assembly is configured to lift the pair of wheels above a lowest point of the pad.

17. The floor scrubber of claim 15, wherein the lift assembly includes a cam that wedges between the motor mounting plate and the chassis to cause rotation about a pivot axis between the motor mounting plate and the chassis.

18. The floor scrubber of claim 17, further comprising a pair of brackets connected to the motor mounting plate that releasably couple to a pair of pins connected to the chassis, the pair of pins defining the pivot axis.

19. The floor scrubber of claim 15, wherein the cleaning pad drive is coupled to the motor via an eccentric cam.

20. A truck unit for a floor machine, the truck unit comprising:

a chassis comprising:

a deck; and first and second rails extending from the deck;

a pair of wheels mounted to the chassis along a rotational axle proximate a first end of the first and second rails, the rotational axle being connected to the chassis in a fixed relationship;

first and second pivot pins mounted to the first and second rails, respectively, proximate a second end of the first and second rails;

a cam shaft supported by the first or the second rail between the first and second ends;

a cam mounted to the cam shaft between the first and second rails; and a lever connected to the cam shaft outside of the chassis.

21. The truck unit of claim 20, further comprising a spring connected to the cam and the chassis to bias the cam in a position between the first and second rails.

22. The truck unit of claim 21, wherein the lever is configured to rotate the cam shaft to extend the cam out from between the first and second rails.

23. The truck unit of claim 20, further comprising a motor mounting plate coupled to the first and second pivot pins at first and second brackets having first and second latches.

24. An apparatus for treating a floor surface, the apparatus comprising:

a chassis;

a pair of wheels configured to rotate on the chassis at a fixed location;

a handle assembly connected to the chassis;

a mounting plate attached to the chassis at a first pivoting connection;

a floor treating assembly connected to the mounting plate, the floor treating assembly including a media drive for a floor treating media; and wherein the chassis, the handle assembly and the pair of wheels are movable relative to the mounting plate at the first pivoting connection between a first operating position and a second operating position;

wherein in the first operating position the chassis is free to rotate at the first pivoting connection with the media drive and the pair of wheels contacting the floor surface, and in the second position the chassis is locked in a pivoted position such that the media drive contacts the floor surface and the wheels are fixed in a raised position above the floor surface.

25. The apparatus of claim 24, wherein the floor treating assembly causes the media drive to move in an orbital pattern about a fixed axis on the mounting plate.

26. The apparatus of claim 24, wherein the handle assembly is connected to the chassis at a second pivoting connection.

27. The apparatus of claim 24, further comprising a positioner comprising:

a cam located on a first side of the first pivoting connection proximate the pair of wheels, the cam configured to push the mounting plate away from the chassis; and rails extending beyond the chassis on a second side of the first pivoting connection opposite the first side, the rails configured to engage the mounting plate to limit rotation of the chassis relative to the mounting plate via the cam.

* * * * *